United States Patent [19]

Auer

[11] Patent Number: 4,478,262

[45] Date of Patent: Oct. 23, 1984

[54] APPARATUS FOR FILLING PORTIONS OF LOOSE MATERIAL INTO PACKAGING CONTAINERS

[75] Inventor: Hugo Auer, Schwaz/Tirol, Austria

[73] Assignee: Robert Bosch GmbH, Stuttgart, Fed. Rep. of Germany

[21] Appl. No.: 417,739

[22] Filed: Sep. 13, 1982

[30] Foreign Application Priority Data

Oct. 24, 1981 [DE] Fed. Rep. of Germany ..... 3142221
Mar. 19, 1982 [DE] Fed. Rep. of Germany ..... 3210102

[51] Int. Cl.³ ..... B65B 1/04

[52] U.S. Cl. ..... 141/114; 222/415; 221/278

[58] Field of Search ..... 141/129-191, 141/250-284, 10, 67, 68, 114, 313-317, 83; 221/278; 222/415, 70

[56] References Cited

U.S. PATENT DOCUMENTS 2,102,584 12/1937 Brown ..... 222/415
4,002,266 1/1977 Beebe ..... 221/278

*Primary Examiner*—Houston S. Bell, Jr.
*Attorney, Agent, or Firm*—Edwin E. Greigg

[57] ABSTRACT

An apparatus is proposed for transferring measured portions of loose material into packaging containers. The individual product portions, after being measured out, are to be filled rapidly and without interruption into packaging containers in such a manner that the product is not damaged thereby. To this end, the apparatus has a conveyor belt disposed beneath a container which prepares the product portions. The conveyor belt stretches out the poured product portions into a rapidly moving stream and directs this stream into a filling pipe leading to the packaging container. Limiting walls and a movable, endless belt form a conduit which guides the stream.

11 Claims, 4 Drawing Figures

APPARATUS FOR FILLING PORTIONS OF LOOSE MATERIAL INTO PACKAGING CONTAINERS

BACKGROUND OF THE INVENTION

The invention is based on a filling apparatus as generally described hereinafter. When portions of loose, bulky material such as potato chips, various sorts of baked goods and the like—measured out by weighing, for example—are being poured into packages, blockages frequently occur, particularly at the inlet of the filling pipe which leads into and is adapted to the opening of the packaging container. The portions of product poured from the scales container into a funnel have a far larger cross section when leaving the scales container than when entering the filling pipe and frequently form "bridges" at the funnel restriction leading to the filling pipe, which causes interruptions in the filling process. In order to loosen up such blockages, a plunger is associated with the filling pipe, and upon each filling cycle the plunger dips from above into the filling pipe.

This apparatus has the disadvantage that the plunger damages and breaks the pieces making up the product. It is also known to associate a one-sided funnel with the filling pipe; the product then slides gradually into the filling pipe on the slanted bottom of the funnel. An apparatus of this type has a limited fill output. For high-speed packaging machines, it is therefore desirable than an apparatus be attained with which measured portions of a product can be introduced into packaging containers rapidly and in such a manner that the product is not damaged.

OBJECT AND SUMMARY OF THE INVENTION

The apparatus according to the invention has the advantage over the prior art in that the compact portions of a product are stretched out by means of accelerating the pieces which fall gradually onto the conveyor belt, and then introduced at high speed into the packaging container in the form of a continuous stream.

By means of the invention disclosed hereinafter, advantageous further embodiments of and improvements to the apparatus are attainable. It is particularly advantageous that a closure is disposed on the apparatus for measuring out the product which gradually opens its outlet more and more so that the pieces of one portion of the product come in contact with the converor belt one after another and are carried along and accelerated with it. This kind of continuous transfer of a portion of the product to the conveyor belt is also attained of the feeding segment of the conveyor belt is located in a plane which extends obliquely upward in the direction of the feed. The conveyor belt is preferably perforated and its feeding segment extends over a vacuum chamber so that the pieces being supplied adhere firmly to the belt.

The invention will be better understood and further objects and advantages thereof will become more apparent from the ensuing detailed description of a preferred embodiment taken in conjunction with the drawings.

DESCRIPTION OF THE PREFERRED EMBODIMENTS

Figure 1:
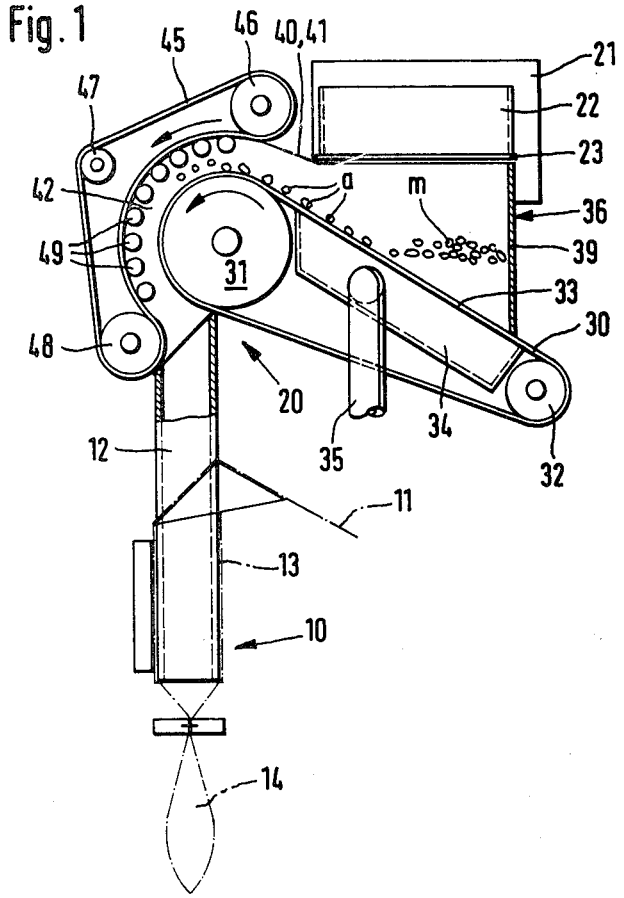
FIG. 1 shows a first exemplary embodiment of an apparatus for filling portions of a product, seen in a side view and partially cut away.

Associated with a packaging apparatus 10—which by way of example shapes a strip 11 of packaging material around a filling pipe 12 to form a tube 13, divides the tube into individual pouch-type packages 14 and fills each of them with a portion of a product—is a filling apparatus 20 for transferring the portions of product one after another from a measuring apparatus, for instance an automatic weighing apparatus 21. The weighing apparatus 21 has a weighing or measuring container 22 having a bottom closure which is embodied as a flap or slide 23. One portion m of the product is poured out at a time from the measuring container 22 into the filling apparatus 20 by means of the opening of the slide 23. The portions m of the product are made up of pourable, loose, and bulky pieces "a", such as potato chips, baked goods and the like.

For the sake of simplicity, identical elements of the various exemplary embodiments are identified by the same reference numerals.

Figure 2:
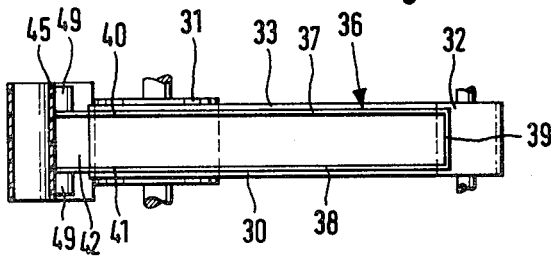
FIG. 2 shows the apparatus of FIG. 1 in a plan view and partially cut away.

In the exemplary embodiment shown in FIGS. 1 and 2, the filling apparatus 20 has an endless conveyor belt 30, which is guided around two deflector rollers 31, 32, of which the deflector roller 31 is driven continuously. One segment 33 of the conveyor belt 30 located below the measuring container 22 within the area into which that container pours out its contents extends such that it overlaps the longitudinal extension of the rectangular cross section of the measuring container 22 and takes an oblique course upward in the feeding direction toward the filling pipe 12. The individual pieces a of one portion m dropping from the measuing container 22 thus contact the conveyor belt 30 one after another and are then carried along by it.

The conveyor belt 30 is driven at a speed of approximately 2.5 to 3.5 meters per second, a speed which is greater than the speed of the product portion m dropping from the measuring container 22. As a result the pieces "a" falling one after another onto the conveyor belt 30 are rapidly carried away as soon as they contact it, so that the product portion m is stretched out into a stream, which is then fed into the filling pipe 12 at a high speed.

In order to increase the frictional adhesion of the pieces "a" to the conveyor belt 30, the conveyor belt 30 is porous or perforated, and its feeding segment 33 extends over a vacuum chamber 34, which is connected via a line 35 to a vacuum source, not shown.

The conveyor belt 30 feeds the product portion m via the deflection path produced by the deflector roller 31 into the filling pipe 12 adjoining it in the perpendicular direction, through which the individual product portions m are fed one after another into the associated end of the tube 13, which is then served to form one pouch-type package 14.

In order to guide the product portions m laterally, a drop chute 36 having two lateral limiting walls 37, 38 and one rear closure wall 39 is disposed between the measuring container 22 and the feeding segment 33 of the conveyor belt 30. In the feeding direction of the conveyor belt 30, the lateral limiting walls 37, 38 have curved extensions 40, 41, which on the deflection path, together with the conveyor belt 30, form a conduit 42 leading to the filling pipe 12. Toward the outside this conduit 42 is covered by means of an endless covering belt 45, which is supported by three deflector rollers 46, 47 48 and is guided in the vicinity of the curved conduit 42 by a plurality of support rollers 49 disposed on a circular arc and having a radius adapted to the outer wall of the conduit 42. The support rollers 49 are rotatably supported on the outer walls of the extensions 40, 41 and contact the covering belt 45 at its two peripheral zones. The covering belt 45 is driven continuously via the deflector roller 48 in the feeding direction of the product portions m, so that an impetus in the direction toward the filling pipe 12 is imparted to pieces "a" striking the covering belt 45. The speed of revolution of the covering belt 45 is set higher than that of the conveyor belt 30.

Figure 3:
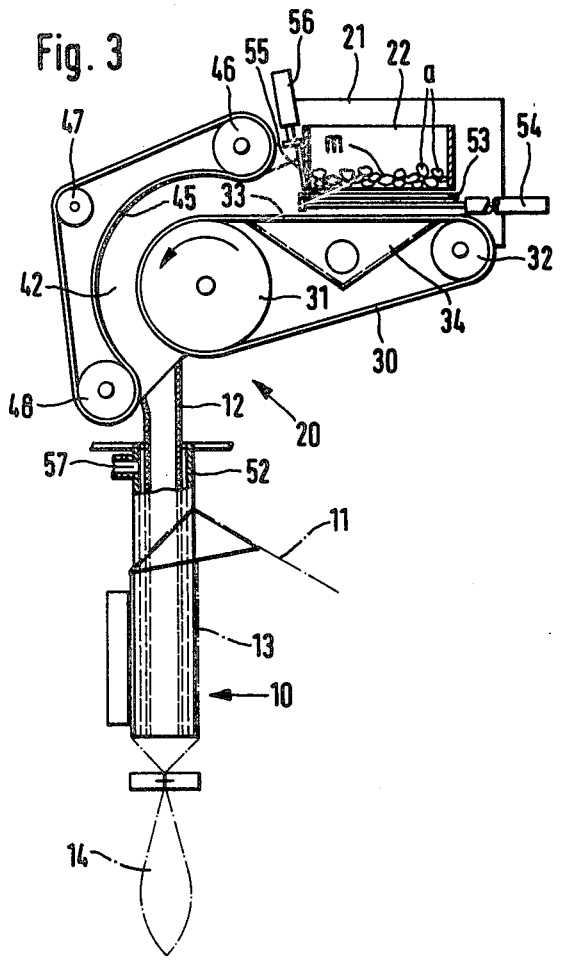
FIG. 3 shows a second exemplary embodiment of an apparatus for filling portions of a product, seen in a side view and partially cut away.

In the exemplary embodiment of FIG. 3, deviating from that of FIGS. 1 and 2, the conveyor belt 30 is disposed such that its feeding segment 33 extends horizontally. In order to transfer a product portion m, which has been prepared in the measuring container 22, gradually to the rapidly-moving conveyor belt 30, the bottom closure of the measuring container 22 comprises a slide 53 which moves back and forth parallel to the longitudinal extension of the feeding segment 33. The slide 53 is actuated by a pneumatic working cylinder 54 in such a manner that for opening the outlet of the measuring container 22, the slide 53 is displaced counter to the feeding direction of the conveyor belt 30, so that the pieces "a" of the product portion m prepared in the measuring container 22 which are located near the filling pipe 12 drop onto the conveyor belt 30 and are carried along by it sooner than those pieces which are located farther away in the measuring container from the filling pipe 12. The endless conveyor belt 30, which revolves at a speed of approximately 2.5 to 3.5 meters per second, in this manner stretches out the pieces "a", which have first been collected to form a product portion m, into a thin stream which is poured at high speed through the deflection conduit 42 and the filling pipe 12 into the end of the tube 13.

In order to attain rapid removal of the pieces a of the product portions m from the measuring container 22, the forward wall of the measuring container 22 is also embodied as a slide 55, which is movable up and down by a working cylinder 56. Both slides 53 and 55 are actuated simultaneously in order to open and close the measuring container 22.

In order to reduce the air flow in the filling pipe 12 which has been built up in the course of the rapid inflow of the stream of the product in the filling pipe 12, a shaping pipe 52 for the tube 13 is disposed coaxially with the filling pipe 12, a gap being left between them. Air which is compressed by the flow of the product is capable of escaping through this gap and though an adjustable opening 57 disposed in the upper part of the shaping pipe 52. Depending upon the size of the cross section of the opening 57, it is possible to vary both the impact speed of the flow of the product in the end of the tube and the air quantity contained in the finished pouch package 14.

Figure 4:
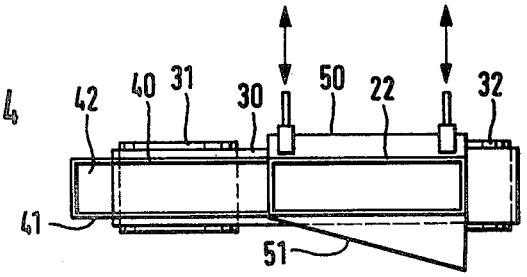
FIG. 4 shows a third exemplary embodiment of an apparatus for filling portions of a product.

In contrast to the exemplary embodiment of FIG. 3, in which the outlet of the measuring container 22 is opened and closed by the slide 53 which is movable parallel to the longitudinal extension of the feeding segment 33 of the conveyor belt 30, the measuring container 22 in the exemplary embodiment of FIG. 4 has a slide 51 with an oblique opening edge 50, the slide 51 being displaceable transversely with respect to the conveyor belt 30. The opening edge 50 extends such that the outlet of the measuring container 22, when the slide 51 is retracted, is gradually opened up counter to the feeding direction of the conveyor belt 30, beginning with the edge located forwardmost in the feeding direction.

It is noted in addition that the container 22 which prepares and pours out the product may be not only a weighing container but instead may also be some intermediate or collecting container, in which the product portions, having been measured out elsewhere, are stored or accumulated in the meantime.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. An apparatus for filling measured portions of loose material in packaging containers, comprising a measuring apparatus for pouring out the measured product portions in increments and having a substantially vertical filling pipe leading to a packaging container, a rapidly-moving conveyor belt (30) leading to the filling pipe (12) disposed beneath the measuring apparatus (22), and means adjacent the measuring apparatus (51, 53, 55) for sequentially transferring the pieces (a) of a single measured product portion (m) contained in the measuring apparatus to the conveyor belt, beginning with those pieces which are located in the measuring apparatus closest to the filling pipe.

2. An apparatus as defined by claim 1, wherein the conveyor belt (30) comprises a segment (33) extending such that it overlaps the measuring apparatus (22), and a deflection means (42) leading to the filling pipe (12) adjoining the segment (33).

3. An apparatus as defined by claim 1 or 2, wherein the transfer means (51, 53, 55) comprises a closure element which gradually opens up the outlet of the apparatus (22).

4. An apparatus as defined by claim 3, wherein the closure element (53) is movable back and forth in the longitudinal extension of the conveyor belt (30) and gradually opens up the outlet of the measuring apparatus in a direction counter to the feeding direction of the conveyor belt.

5. An apparatus as defined by claim 3, wherein the closure element (51) is movable back and forth transversely with respect to the longitudinal extension of the conveyor belt (30) and gradually opens up the outlet of the measuring apparatus in the direction counter to the feeding direction of the conveyor belt.

6. An apparatus as defined by claim 3, wherein the closure element (55) is normal to the longitudinal extension of the conveyor belt (30) and comprises the nearest wall of the measuring apparatus to the filling pipe (12).

7. An apparatus as defined by claim 2, wherein the feeding segment (33) of the conveyor belt (30) extends substantially parallel with respect to the plane of the measuring apparatus.

8. An apparatus as defined by claim 2, wherein the feeding segment (33) of the conveyor belt (30) extends obliquely upward with respect to the plane of the measuring apparatus.

9. An apparatus as defined by claim 2, wherein the deflection means (42) comprises lateral walls (37, 38, 40, 41) defining a conduit oriented toward the feeding segment (33) of the conveyor belt (30) and the filling pipe (12).

10. An apparatus as defined by claim 9, further comprising, an endless covering belt (45) having means (49) for being guided in a curved fashion for covering the conduit (42).

11. An apparatus as defined by claim 2 or 3, wherein the conveyor belt (30) is porous and its feeding segment (33) extends above a vacuum chamber (34).

* * * * *